United States Patent [19]

Papp

[11] Patent Number: 4,614,065

[45] Date of Patent: Sep. 30, 1986

[54] ADJUSTABLE PLUMBING CLEANOUT

[76] Inventor: David J. Papp, 431 N. Grandview Blvd., Waukesha, Wis. 53186

[21] Appl. No.: 739,528

[22] Filed: May 31, 1985

[51] Int. Cl.[4] ..... E02D 29/14

[52] U.S. Cl. ..... 52/20; 52/220; 404/26

[58] Field of Search ..... 52/20, 21, 220, 221; 404/26; 210/163, 164, 166; 138/89; 285/DIG. 2

[56] References Cited

U.S. PATENT DOCUMENTS

| | | | |
|---|---|---|---|
| 1,712,895 | 5/1929 | Metcalf | 52/220 |
| 1,779,936 | 10/1930 | Hess | 210/163 |
| 1,826,555 | 10/1931 | Lonskey | 210/163 |
| 1,945,707 | 2/1934 | Sharp | 52/221 |
| 2,190,532 | 2/1940 | Lukomski | 210/164 |
| 2,324,545 | 7/1943 | Svirsky | 52/220 |
| 2,471,301 | 5/1949 | Boosey | 138/89 |
| 2,626,674 | 1/1953 | Boosey | 182/31 |
| 3,420,552 | 1/1969 | Mork | 285/42 |
| 4,433,860 | 2/1984 | Lindquist | 285/192 |

FOREIGN PATENT DOCUMENTS

| | | | |
|---|---|---|---|
| 465229 | 5/1937 | United Kingdom | 52/221 |

*Primary Examiner*—Henry E. Raduazo
*Attorney, Agent, or Firm*—Henderson & Sturm

[57] ABSTRACT

An adjustable cleanout apparatus having an inner cylindrically shaped body with an outer portion thereof having threads thereon, such inner body having a predetermined inner diameter. Holes extend through the bottom of the inner body for permitting the inner body to be attached to an upstanding plumbing cleanout pipe. A lead and oakum joint is formed between the outer top portion of the cleanout pipe and the inner portion of the inner body. A cylindrical member having an outer diameter larger than the diameter of the outer portion of the inner body is utilized to be disposed over the inner body so that a concrete floor poured around the cylindrical member will not come into contact with a substantial portion of the threads of the inner body whereby such cylindrical member can be selectively removed from around the inner body after the concrete is cured. An outer cylindrical shaped body having an outer diameter no larger than the outer diameter of the cylindrical member and having threads on the interior thereof permit this other body to be threadably engaged with the threads on the exterior of the inner body whereby the outer body can be placed in the space vacated by the cylindrical member. Rotation of the outer body in one direction will move it upwardly and rotation of the outer body in an opposite direction will move it downwardly.

5 Claims, 12 Drawing Figures

ADJUSTABLE PLUMBING CLEANOUT

TECHNICAL FIELD

The present invention relates generally to plumbing cleanout structures and more particularly to a plumbing cleanout apparatus which is adjustable vertically to conform to the level of a concrete floor poured therearound and which is also adjustable in pitch so that the top thereof conforms to the pitch of the concrete floor.

BACKGROUND ART

Plumbing cleanout structures are typically used for storm sewers, sanitary sewers or other kinds of plumbing installations where a cleanout access is desirable or necessary. Many plumbing codes require a plumbing cleanout structure to be attached to any plumbing system.

Typically, a plumbing cleanout apparatus consists of a pipe extending up through the floor of a basement. The problem has been one of adjusting the top of the plumbing cleanout to be level with and in alignment with the concrete floor. Because adjusting mechanisms have not been available to accomplish this result without inordinate trouble and expense, often times the cleanout does not conform precisely to and is not in alignment with the top of the floor. Consequently there is a need for an improved adjustable plumbing cleanout apparatus which will easily accomplish this function.

DISCLOSURE OF THE INVENTION

The present invention relates generally to an adjustable cleanout apparatus having an inner cylindrically shaped body with an outer portion thereof having threads thereon, such inner body having a predetermined inner diameter. Holes extend through the bottom of the inner body for permitting the inner body to be attached to an upstanding plumbing cleanout pipe. A lead and oakum joint is formed between the outer top portion of the cleanout pipe and the inner portion of the inner body. A cylindrical member having an outer diameter and an inner diameter larger than the diameter of the outer portion of the inner body is utilized to be disposed over the inner body so that a concrete floor poured around the cylindrical member will not come into contact with a substantial portion of the threads of the inner body whereby such cylindrical member can be selectively removed from around the inner body after the concrete is cured. An outer cylindrical shaped body having an outer diameter no larger than the outer diameter of the cylindrical member and having threads on the interior thereof permit this other body to be threadably engaged with the threads on the exterior of the inner body whereby the outer body can be placed in the space vacated by the cylindrical member. Rotation of the outer body in one direction will move it upwardly and rotation of the outer body in an opposite direction will move it downwardly. A set screw is provided for holding the outer body in whatever position it is desired, for example just below the top of the level of the concrete floor. A plug is provided for selectively sealing the top of the inner body and a cap is adapted to engage the top of the outer body. A bolt extends through the central portion of the cap and threads into the plug whereby the cap will be held in place. The cap has a partially spherical surface around the lower outer periphery thereof and the top of the outer body has a complementary shaped partial spherical surface thereon providing a mating slidable joint cap and the outer body whereby the cap can tip with respect to the outer body so that the pitch on the top of the cap can conform to the pitch of the floor.

An object of the present invention is to provide a completely adjustable plumbing cleanout apparatus.

Another object of the present invention is to provide an adjustable plumbing cleanout apparatus which is adjustable vertically.

A further object of the present invention is to provide an adjustable plumbing cleanout apparatus of the aforementioned type which has a cap thereon which is adjustable in pitch so as to be aligned with the top of a concrete floor whether or not that floor is level.

A still further object of the present invention is to provide a method of installing the adjustable plumbing cleanout apparatus which utilizes a removable cylindrical member for use in shielding the adjustable plumbing cleanout parts from concrete poured around it.

Other objects, advantages, and novel features of the present invention will become apparent from the following detailed description of the invention when considered in conjunction with the accompanying drawings.

BEST MODE FOR CARRYING OUT THE INVENTION

Figure 1:
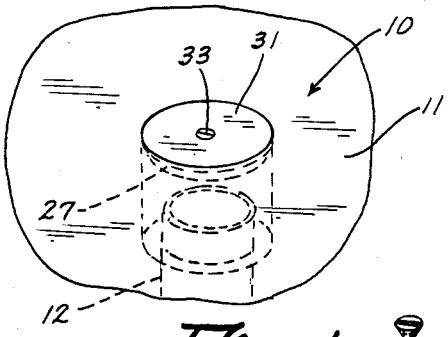
FIG. 1 shows a perspective view of a plumbing cleanout apparatus installed in a concrete floor.
Figure 3:
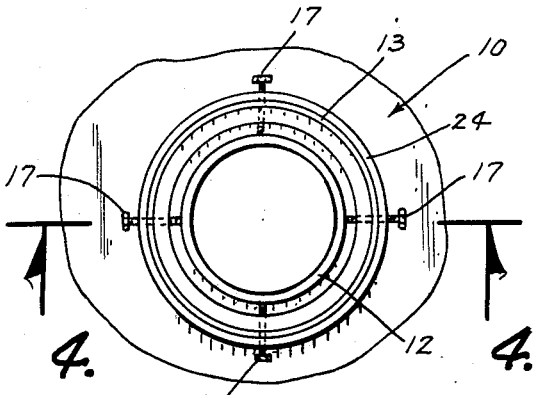
FIG. 3 is a top view of step one for installation of the adjustable plumbing cleanout mechanism of the present invention.
Figure 2:
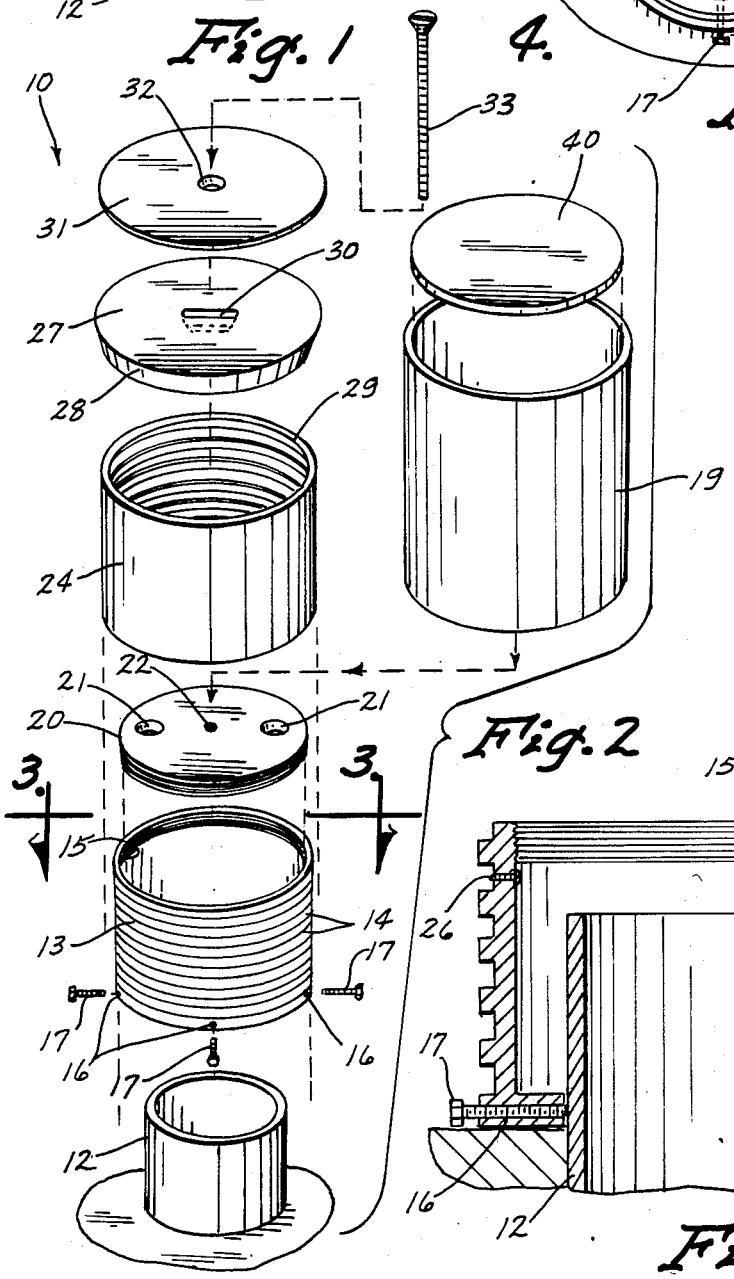
FIG. 2 is an enlarged exploded perspective view of the various parts of the adjustable plumbing cleanout apparatus of the present invention.
Figure 4:
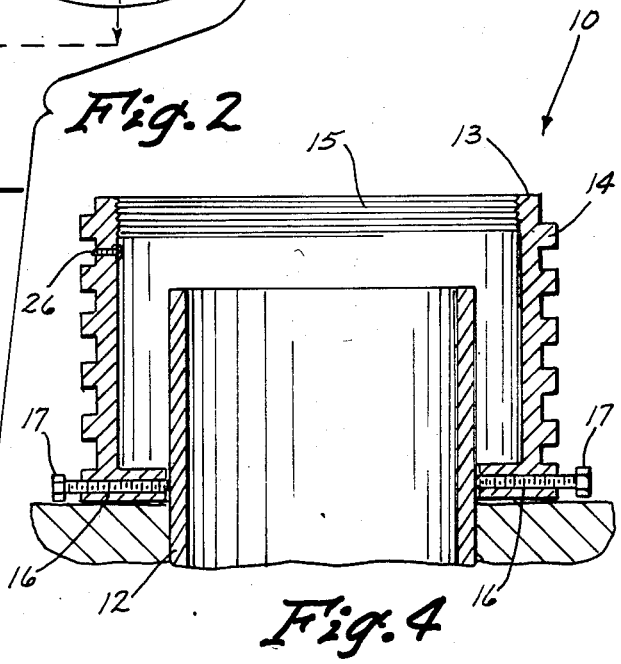
FIG. 4 is a cross sectional view taken along line 4—4 of FIG. 3.
Figure 5:
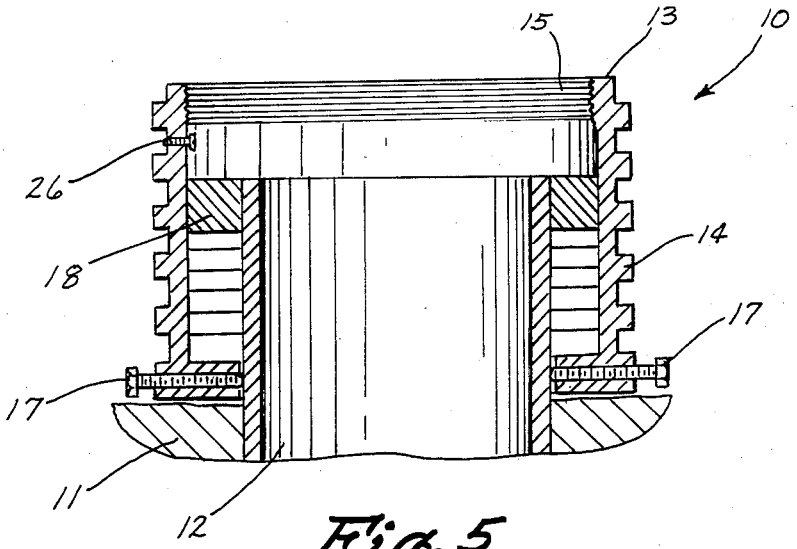
FIG. 5 is a view like FIG. 4, but showing a lead and oakum joint formed to make a seal between the upstanding cleanout pipe and the threaded inner body attached thereto.

Referring now to the drawings wherein like reference numerals designate identical or corresponding parts throughout the several views, FIG. 1 shows an adjustable plumbing cleanout mechanism (10) installed in a concrete floor (11). Referring to FIGS. 2 and 4, it is noted that a plumbing cleanout pipe (12) extends upwardly into the basement floor of a building or the like prior to the time that a concrete floor is poured therein. An inner body (13) has exterior threads (14) disposed thereon and interior threads (15). Four openings (16) are disposed through and around the bottom of the inner body (13) and these openings (16) are threaded to receive bolts (17). These bolts (17), for example as shown in FIG. 4, are utilized to clamp and hold the inner body (13) to the upstanding cleanout pipe (12). After the inner body (13) is positioned in the FIG. 4 position, referring to FIG. 5, a lead and oakum joint (18) is formed by packing such oakum and pouring approximately one inch of molten lead between the cleanout pipe (12) and the inner portion of the inner body (13) to form a seal therebetween.

Figure 6:
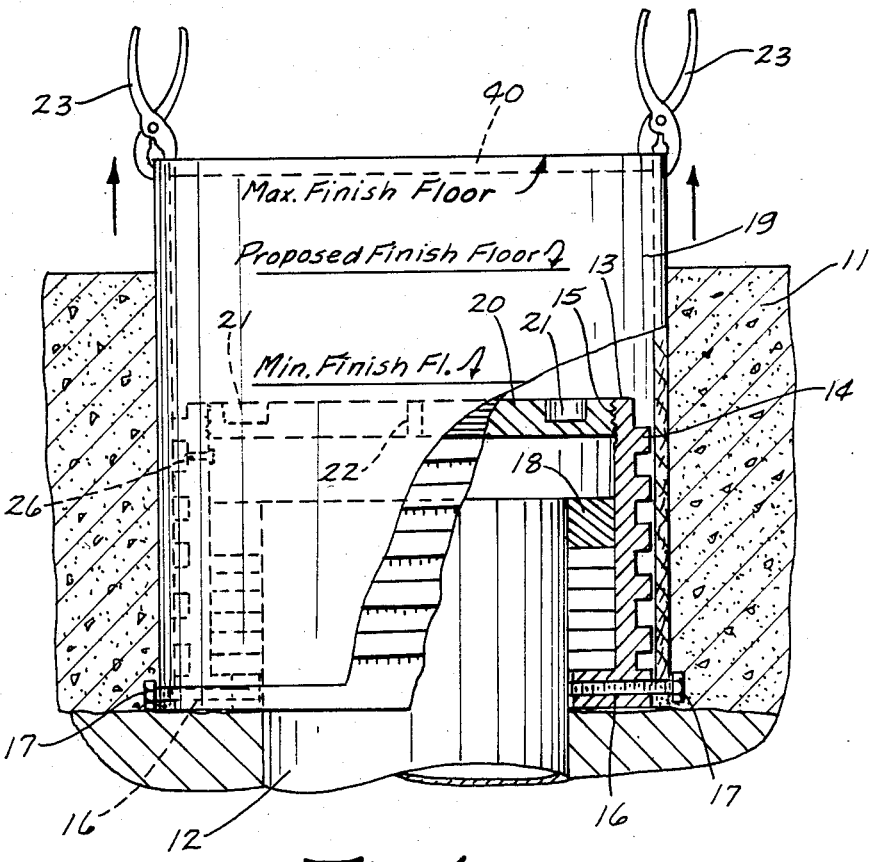
FIG. 6 is a partial cross sectional view of another step in the process of installing the adjustable plumbing cleanout apparatus of the present invention and showing how a removable cardboard cylindrical member is utilized while a concrete floor is being poured and is then removed after concrete is cured.

The next step of the process of installing the adjustable plumbing cleanout apparatus of the present invention is to place a removable cylindrical member (19) in the position shown in FIG. 6 wherein a concrete floor (11) can be poured therearound and the concrete will not flow into the space where the cylindrical member (19) is disposed. It is also noted that a brass plug (20) having threads around the exterior thereof is threadably attached to the threads (15) on the interior of the inner body (13). This plug (20) has partially drilled openings (21) to assist in the removal of such plug using the handle ends of pliers. The plug (20) also has a central threaded opening (22). The cylindrical member (19) has a cardboard cover (40) to prevent any concrete from passing down to the inner body (13).

Figure 7:
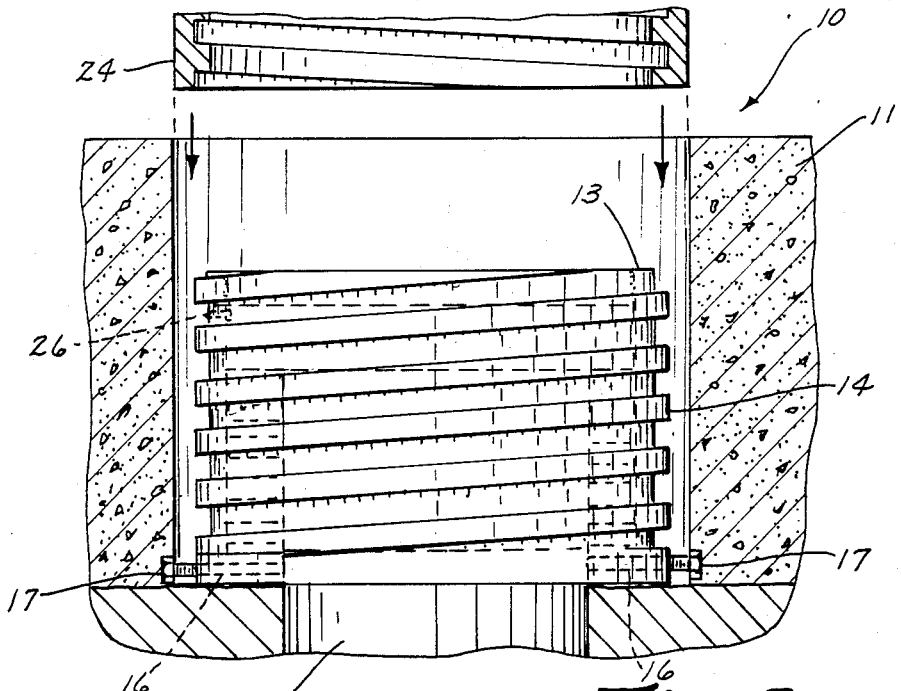
FIG. 7 shows the next step for installation of the adjustable plumbing cleanout apparatus showing an outer cylindrical body in readiness to be screwed onto the inner cylindrical body.
Figure 8:
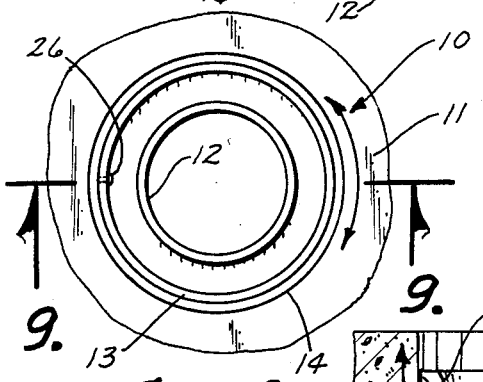
FIG. 8 is a top view of the adjustable plumbing cleanout apparatus after the outer cylindrical body is screwed onto the inner cylindrical body as shown in FIG. 7.
Figure 9:
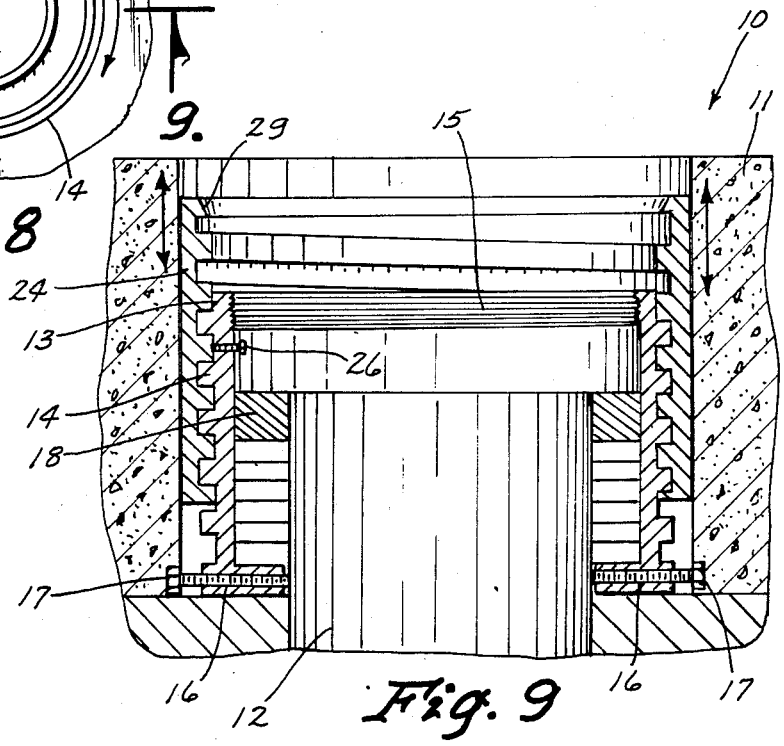
FIG. 9 is a cross sectional view taken along line 9—9 of FIG. 8 and showing how the outer cylindrical body can be adjusted vertically to the desired position thereof and a set screw utilized to lock the two cylindrical bodies in such desired position.
Figure 10:
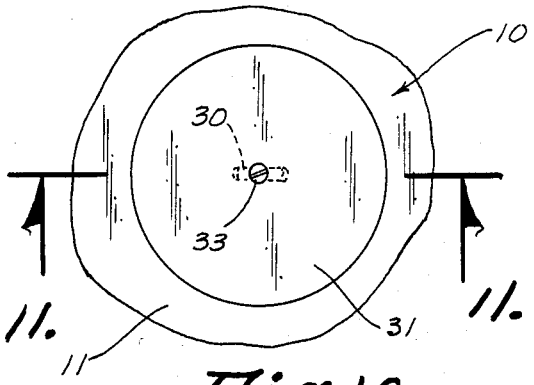
FIG. 10 is a top view showing the adjustable plumbing cleanout apparatus of the present invention having a cap attached thereto in its final installed position.

After the concrete (11) has dried, pliers (23) or any other similar tool can be utilized to remove cardboard cap (40) and to grasp the cylindrical member (19) and pull it out from the concrete (11) and from around the inner member (13). Once that has been done, referring to FIG. 7, the outer body (24) can be moved into the space vacated by the cylindrical member (19) and threadably engaged with the threads on the inner body (13). The outer body (24) is rotated to the desired position just below the top of the concrete floor (11), for example as shown in FIG. 9. Then a set screw (26) can be utilized to be tightened down against the outer body (24) to make sure that the outer body (24) will not move with respect to the inner body (13), unless an adjustment is desired to be made and the set screw (26) is first loosened. After set screw (26) is tightened, plug (20) can be installed and tightened.

Figure 11:
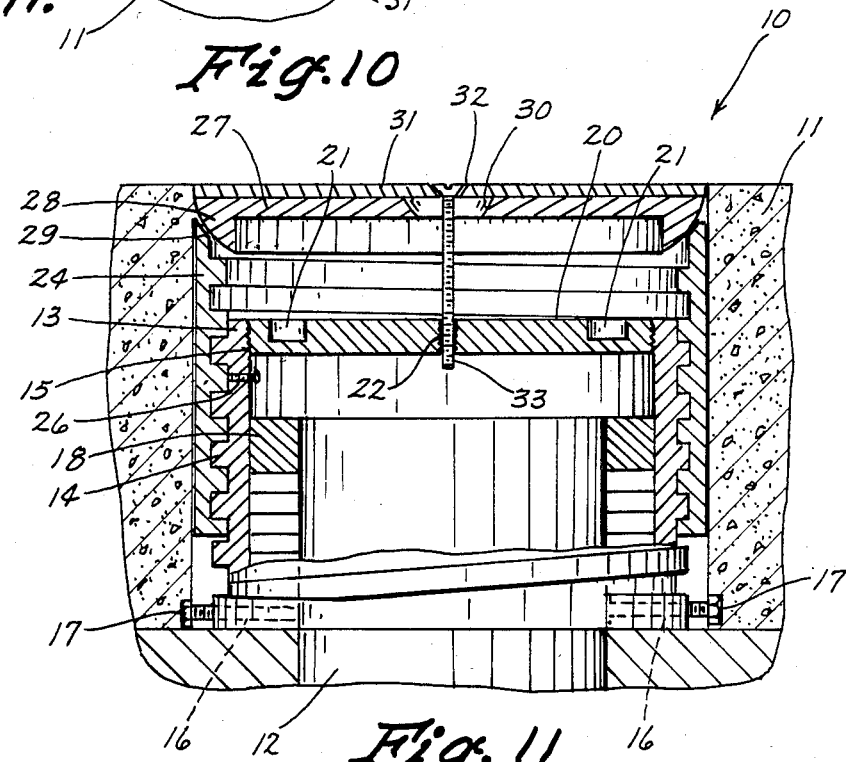
FIG. 11 is a cross sectional view taken along line 11—11 of FIG. 10.
Figure 12:
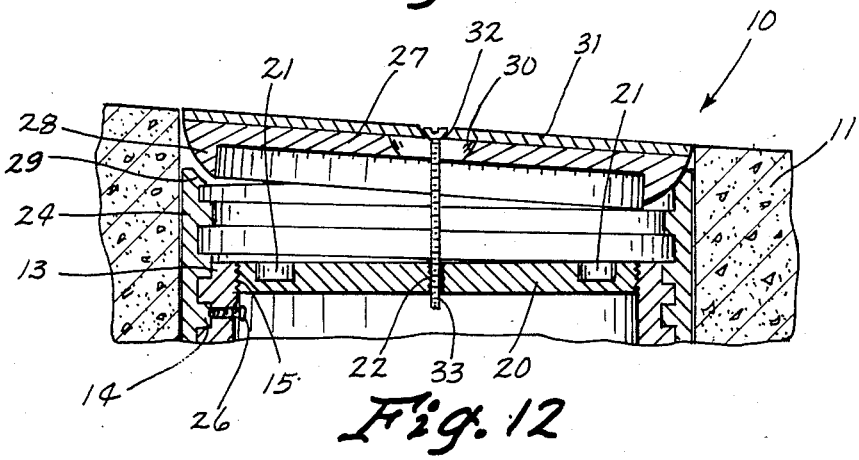
FIG. 12 is a cross sectional view similar to FIG. 11, but showing the present invention adjusted to conform to a concrete floor having a pitch which is not horizontal.

Referring now to FIG. 11, it is noted that a cap (27) having an outer and lower peripheral surface (28) thereon which is of a spherical configuration conforms to a complementary and mating partially spherical surface (29) on the top inner periphery of the outer body (24). This cap member (27) has a central opening (30) which is elongated for purposes which will be discussed below. The top plate (31) can be constructed of chrome plated brass if appearance is important. An opening (32) is disposed centrally in the circular coverplate (31) and a threaded bolt (33) is disposed down through the central opening (32), through the opening (30) in the cap member (27) and is threadably engaged into the opening (22) in the plug (20). The bolt (33) is screwed down tightly to hold the coverplate (31) and cap (27) securedly to the top surface (29) to the outer member (24). When the floor (11) is level, for example as shown in FIG. 11, then the only adjustment that may be necessary is the outer body (24) with respect to the inner body (13). This vertical adjustment was described above. However, if the floor (11) is not level, such as shown in FIG. 12, then with the bolt (33) loosened, the cap (27) and cover (31) can be tipped to one side to adjust to the pitch of the floor. After such adjustment has been made, then the bolt (33) is tightened down to secure the cap (27) and cover (31) to the position shown in FIG. 12.

Obviously many modifications and variations of the present invention are possible in light of the above teachings. It is therefore to be understood that, within the scope of the appended claims, the invention may be practiced otherwise than as specifically described.

I claim:

1. An adjustable plumbing cleanout apparatus comprising:

an inner cylindrically shaped body having an outer portion having threads disposed on the exterior thereof, and having a predetermined inner diameter;

means for attaching said inner body to a top portion of a plumbing cleanout pipe having an outer diameter smaller than said predetermined inner diameter of the inner body;

means for forming a seal between the outer top portion of said cleanout pipe and the inner portion of said inner body;

a cylindrical member having an outer diameter and an inner diameter larger than the diameter of said outer portion inner body whereby said cylindrical member can be selectively slideably disposed over said inner body so that concrete poured around said cylindrical member will not come into contact with a substantial portion of the threads on the inner body and whereby said cylindrical member can be selectively removed from around said inner body after the concrete has cured;

an outer cylindrically shaped body having an outer diameter no larger than the outer diameter of said cylindrical member and having thread means on the interior thereof for mating with the outer thread means on said inner body whereby said outer body can be threaded onto said inner body in a space vacated by said cylindrical member, disposed between the cured concrete and the inner body;

plug means for selectively sealing the top of said inner body;

cap means adapted to engage the top of said outer body, said cap means having a partially spherical surface around the lower outer periphery thereof and the top of said outer body having a complementary shaped partial spherical surface thereon for providing a mating slideable joint between said cap means and said outer body; and means for attaching a central portion of said cap means with said plug means whereby said cap means will be held in place.

2. The apparatus of claim 1 wherein said cylindrical member is made of wax coated cardboard.

3. The apparatus of claim 1 wherein said attaching means is a bolt threadably engageable with a threaded opening in the top of said plug means, said cap means having an opening therein through which said bolt is received.

4. The apparatus of claim 1 including set screw means attached to said inner body for selectively holding said outer body fixed with respect to said inner body.

5. The apparatus of claim 3 wherein said opening in the cap means comprises an elongated slot to allow said cap means to tip to one side so as to be in alignment with the top of the concrete floor whether or not the pitch of the concrete floor is horizontal or not.

* * * * *